United States Patent [19]

Boyd

[11] Patent Number: 4,987,716

[45] Date of Patent: Jan. 29, 1991

[54] ROOFING SYSTEM USING STANDING SEAM JOINTS

[75] Inventor: Thomas J. Boyd, Wellsburg, W. Va.

[73] Assignee: The Louis Berkman Company, Steubenville, Ohio

[21] Appl. No.: 415,554

[22] Filed: Oct. 2, 1989

[51] Int. Cl.[5] ..... E04B 1/06

[52] U.S. Cl. ..... 52/520; 52/537

[58] Field of Search ..... 52/528, 553, 520, 537, 52/465

[56] References Cited

U.S. PATENT DOCUMENTS

| | | | |
|---|---|---|---|
| 357,634 | 2/1887 | Sagendorph | 52/520 |
| 446,217 | 2/1891 | Dickelman | 52/528 |
| 631,092 | 8/1899 | Reese | 52/528 |
| 731,264 | 5/1903 | Armstrong et al. | 52/520 |
| 740,838 | 10/1903 | Flatau | 52/520 |
| 1,076,065 | 10/1913 | Roth | 52/553 |
| 3,353,319 | 11/1967 | Gronlund | 52/520 |
| 4,096,681 | 6/1978 | Netterstedt et al. | 52/713 |

FOREIGN PATENT DOCUMENTS

| | | | |
|---|---|---|---|
| 53010 | 8/1890 | Fed. Rep. of Germany | 52/553 |

OTHER PUBLICATIONS

The Making, Shaping and Treating of Steel, The U.S. Steel Corporation, 1957 pp. 655–659, Sci. Lib. Call No. TN T30 C16, 1957.

*Primary Examiner*—James L. Ridgill, Jr.

*Attorney, Agent, or Firm*—Body, Vickers & Daniels

[57] ABSTRACT

An improved method and apparatus is disclosed for a roofing system which uses an improved standing seam joint such that the roofing system can be used for flat roof applications. A standing seam is conventionally formed and then compressed in a press fit manner by compression apparatus. Provisions are made to apply a gasket material to the compressed sections of the standing seam prior to compression which material is deformed when the seam is compressed to provide a sealed joint which is significantly stronger than the conventional standing seam.

9 Claims, 6 Drawing Sheets

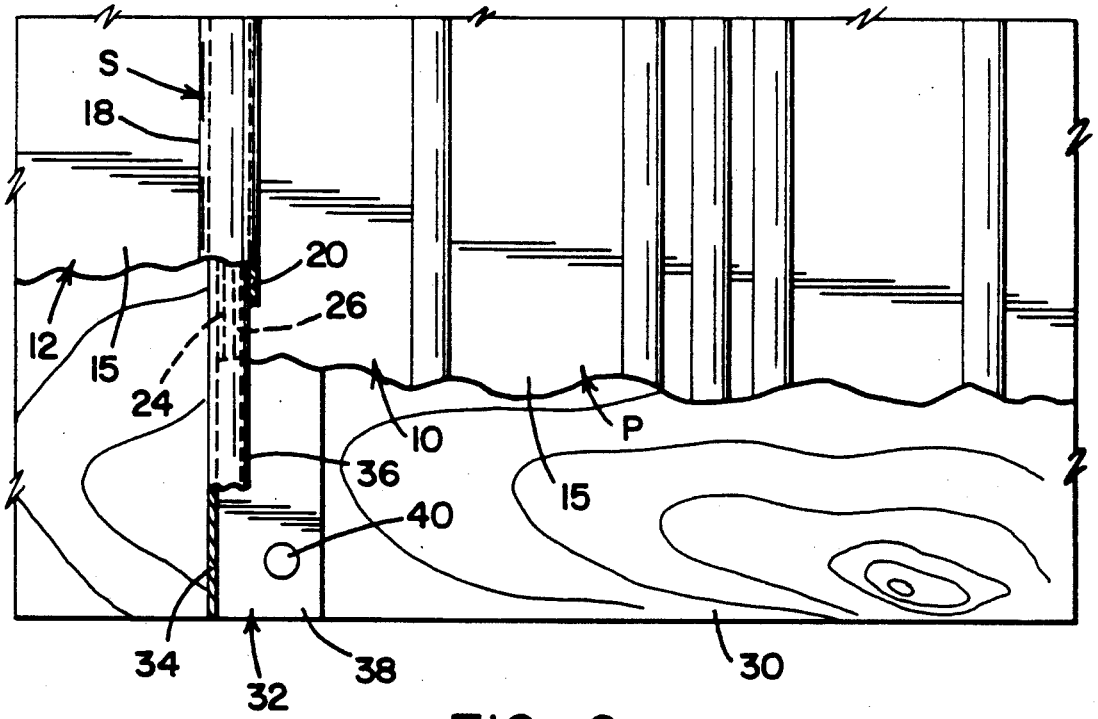
FIG. 6
FIG. 5
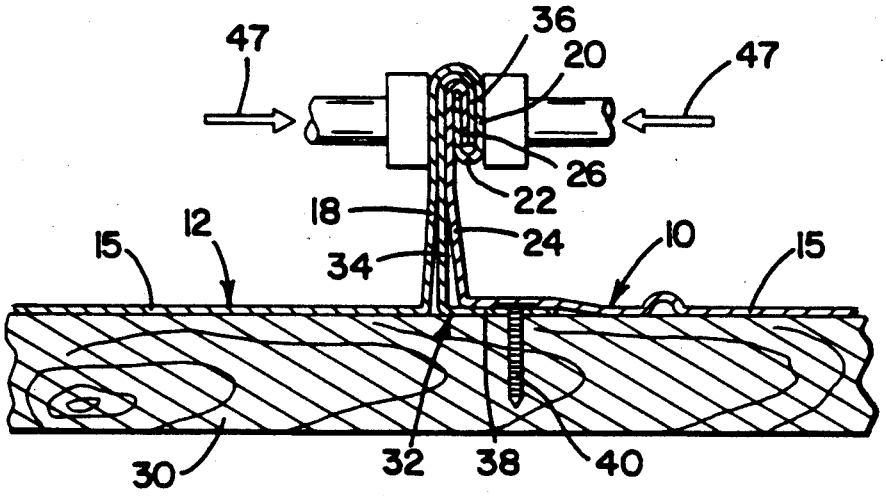

FIG. 7
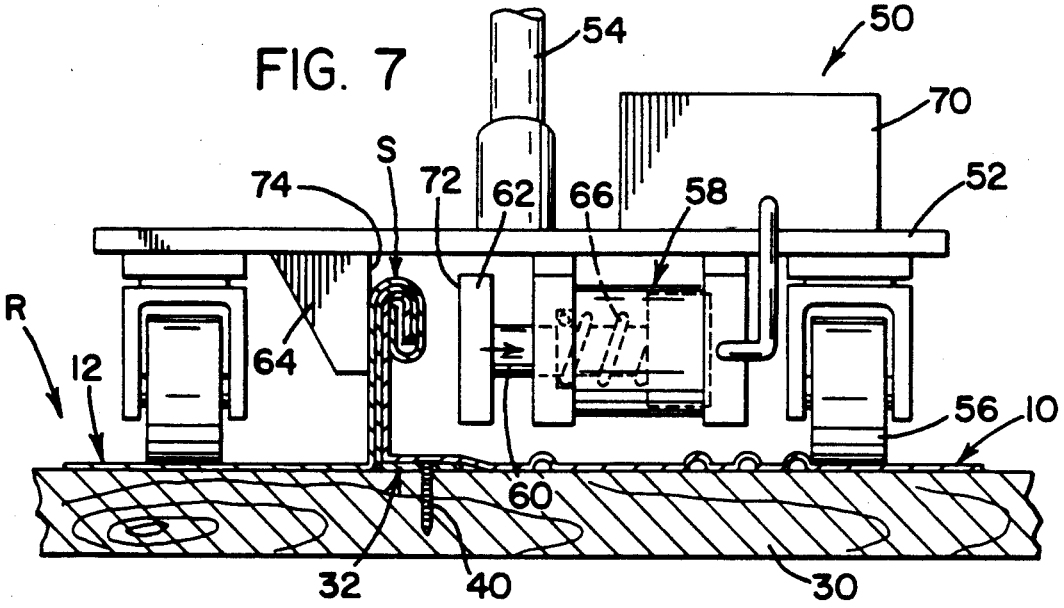
FIG. 8
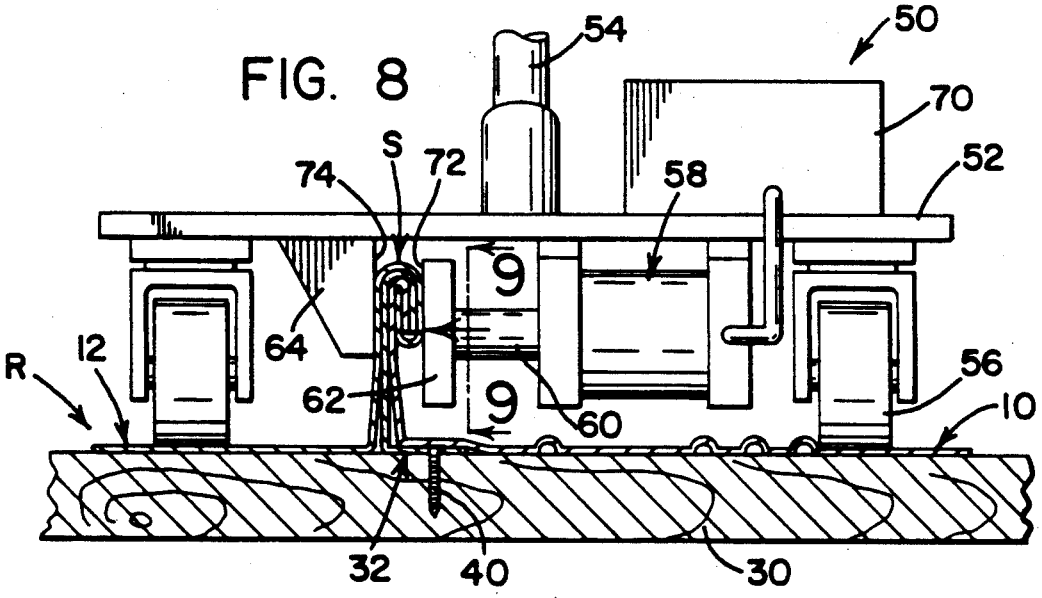
FIG. 9
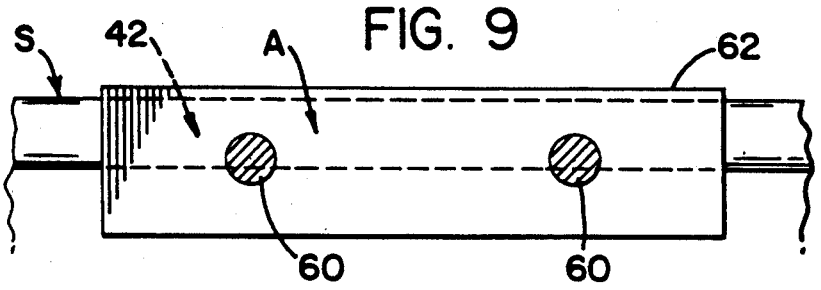
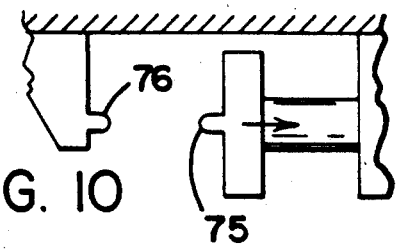
FIG. 10
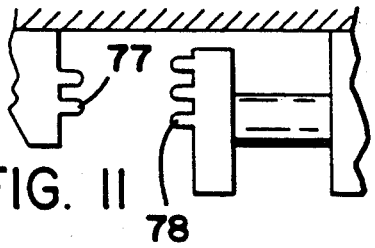
FIG. 11

FIG. 16
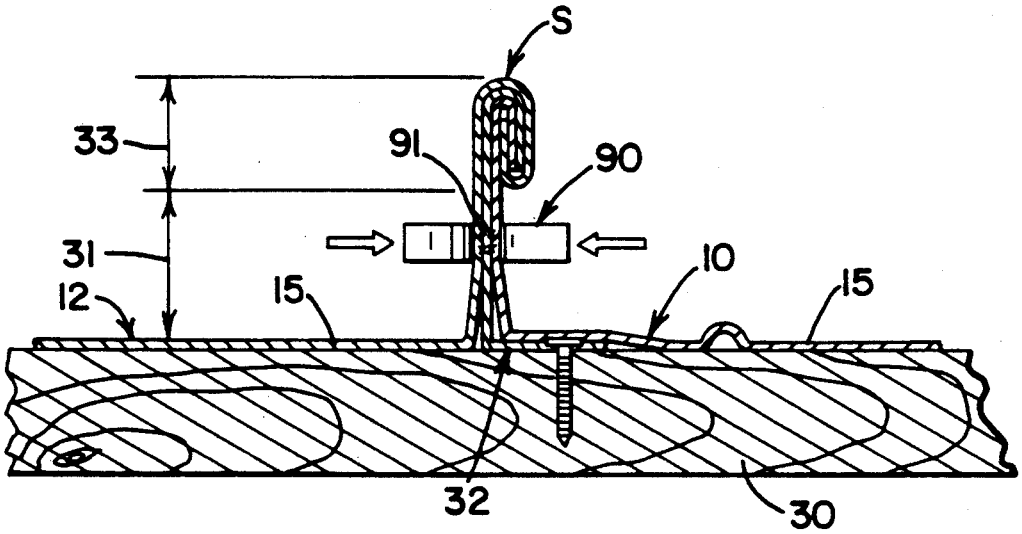
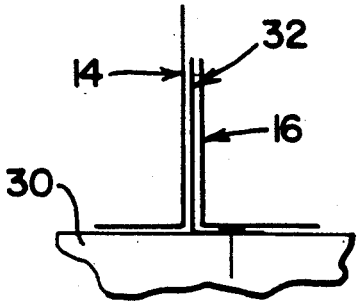
FIG. 12a
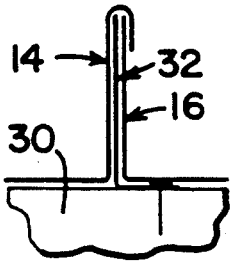
FIG. 12b
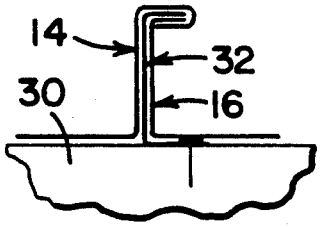
FIG. 12c
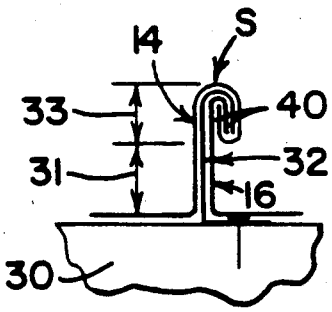
FIG. 12d
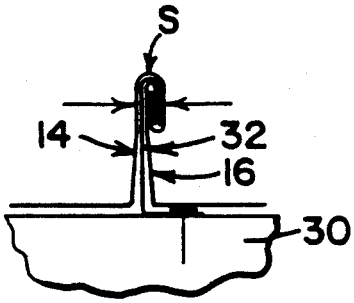
FIG. 12e

ROOFING SYSTEM USING STANDING SEAM JOINTS

The present invention pertains to the art of sheet metal roofing assemblies, and particularly to the structure of a standing seam joint between adjoining sheet metal roofing panels. The invention also pertains to an apparatus for constructing a standing seam joint.

INCORPORATION BY REFERENCE

Incorporated by reference herein and forming a part hereof are Gronlund U.S. Pat. No. 3,353,319 and Netterstedt U.S. Pat. No. 4,096,681.

BACKGROUND OF THE INVENTION

Sheet metal panels are commonly used as components of commercial roofing structures. An assembly of panels is fastened together to form a generally flat cover over a roof substrate which may comprise a framework of wood or metal joists, a plywood surface supported on an underlying framework of joists, poured concrete or the like.

One type of joint structure commonly used for sheet metal roofing panels is that used to assemble the traditional flat lock roof. A flat lock roof panel has edge sections folded back over the main section of the panel to form hemmed edges. The hems are left slightly open to permit hooked engagement with the oppositely facing hem of an adjacent panel to form a joint defined by the overlapping hem sections. The joints are soldered to provide a watertight seal. Although used consistently for many years, this type of joint structure has several problems. For example, the engaged hem sections, when considered in cross-section, comprise four layers of sheet metal material which must be thoroughly heated from above to create conditions wherein the molten solder will be drawn into the joint sufficiently to form a reliable watertight seal. The soldering portion of the assembly process is thus time consuming and skillfully demanding. Soldering problems also arise where the sheet metal panels are nailed or otherwise fastened to the underlying substrate since those punctures through the sheet metal material must be sealed against the influx of water. Furthermore, sealing the joint with solder results in a rigid connection between adjoining panels which cannot yield to the strenuous forces induced by thermal expansion and contraction, and which may in turn cause buckling of the sheet metal material or breakage of the soldered seal.

A different type of joint structure for sheet metal roofing panels which overcomes several disadvantages of a flat lock joint structure is known as a standing seam. A standing seam, as opposed to the primarily horizontal configuration of a flat lock joint, has a vertical orientation with respect to the joint panels. Generally speaking, a standing seam is formed by first bending the edge portions of the roof panels to form vertically extending edge portions and adjacent panels are positioned on the roof so that adjacent edge portions are abutted against one another. A crimping or seaming machine is then used to fold the top edge sections to one side of the edge portions to form an overlapping standing seam. Thus, the edge portions of the panels are seamed about their top edge sections and unseamed at their bottom vertically-extending web sections. To avoid nailing the panels to the roof substrate conventional cleats have been used. Cleats have a horizontal base secured to the roof structure and a vertically extending web which fits between the panel edge portions so that one panel's edge portion abuts one side of the web while the adjacent panel's edge portion abuts the other side of the web. The top edge section of the web is folded over on one side along with the top edge sections of the edge portions of the panels to form the standing seam. While the joint is strengthened by the folding of the edge sections and the seam is relatively rigid, the edge sections of the joint are not in substantial line-to-line or face-to-face contact. Spaces exist within the seam. However, a particular advantage which standing seams have over flat lock joints is the fact that a standing seam does not need to be soldered since the juncture between the folded panel edges, where water might otherwise enter, is spaced vertically above the horizontal roof surface across which water drainage will flow. Thus, the spaces within the seam are not significantly detrimental. On the other hand, this advantage is offset by the fact that a standing seam may yet fail to provide adequate protection against the influx of water under conditions wherein the buildup of ice and snow would reach the vertically spaced folded connection between the joint panels and possibly force the entry of water between the folded edges. For this reason, standing seams have heretofore been used only for roofs having at least a pitch of 1 to 4, which is about a 14 degree vertical angle, in order to insure that accumulated ice and snow would slide off of the roof before reaching the vertically spaced seam.

The prior art has recognized the inability of roofing systems to use standing seams to construct flat roofs. One system, marketed in Europe under the name System Fagersta and described in the patents incorporated by reference above, produces a standing seam which can be applied to flat roofs. Basically, this system uses special cleats as described in the '681 patent and continuously welds the top edge sections of the edge portions of abutting panels before folding the top edge sections over onto one side as described in the '319 patent. The weld is positioned within the seam. Water which enters the space between the vertical edge sections through the folded seam would be blocked from further entry into the roofing assembly by the welded seam. However, any breaks or defects in the weld would defeat the watertight integrity of the joint. Furthermore, water trapped between the joint panel sections could possibly cause cracks or other leaks in the welded seam when expanding upon freezing.

The prior art fails to provide a standing seam joint structure for sheet metal roofing panels which provides adequate protection against the influx of water without the need for seam welding of the joint panel sections or soldering of the standing seam if the standing seam is to be used for roofing assemblies having little or no pitch.

SUMMARY OF THE INVENTION

It is thus a principal object of the subject invention to provide a sheet metal roofing assembly which includes a strong and watertight standing seam joint between adjacent roofing panels which doesn't have to be welded or soldered and which is suitable for roofs having little or no slope or pitch.

This object along with other features of the invention is achieved in a sheet metal roof assembly which includes a plurality of roof panels inclined in a generally horizontal plane having vertically extending edge portions. Each edge portion has edge sections at the ends thereof and the panels are positioned adjacent one another so that an edge portion of one panel abuts the edge portion of the other panel and the edge section of one of the adjacent panels is bent over and overlaps the edge section of the other adjacent panel to define a standing seam joint. The edge sections are in a press fit contact with each other such that substantially no space exists between the edge sections. Significantly, a gasket arrangement within the edge section seals the joint in a solderless manner so that a soldered and weld-free standing seam joint results which permits the roofing assembly to be installed for roofs with little pitch, i.e. less than 3 to 1.

In accordance with another principal feature of the invention, there is provided a method of closing and sealing a seam between two vertical edge portions of sheet metal roofing panels. The method comprises the steps of providing a gasket material to at least one portion of one of the vertical panel edge sections and placing the vertical panel portions in substantially abutting adjacent positions to define an elongated direction of the joint. The panel sections are then folded together transversely to the elongated direction of the joint to define folded end sections at the top of the edge portions and generally distinct unfolded web sections at the bottom of the edge portions. The standing seam is then closed and sealed by press fitting the folded edge sections together while deforming the gasket material so that no space substantially exists in the edge section.

In accordance with a more specific feature of the invention, the gasket arrangement is preferably provided by using roofing panels which are Terne Coated stainless steel of sheet metal gauge. The Terne Coating has sufficient thickness to plastically flow while the seam is press fitted to provide a seal. Alternatively, if the panels are formed from stainless or plain carbon steels, a solder gasket (or even rubberized caulk) is applied as a cap to one of the edge sections of the panel portions to provide a sealable arrangement which is deformed when the seam is pressed together in a press fit type manner. Preferably, the system is installed with a continuous cleat having a web section interposed between the edge portions of the sheet metal pans. The web section is folded over with the edge sections of the pan's edge portions to produce a seven ply standing seam. Importantly, the solder cap or, alternatively, the Terne Coating could be applied to only the web section of the cleat to effect the desired seal when the seam is press fitted.

In accordance with another specific feature of the invention, the folded edge sections of the panel's edge portions of the standing seam are pressed together with a compressive pressure at a level within a range extending from approximately 1,000 psi to 3,333 psi. Preferably, the compressive pressure level is approximately 2,000 psi. These pressure levels are found in practice of the invention to securely and tightly seal the standing seam against the influx of water for accumulated snow and ice by closing out the spaces between the overlapping folded sections of the joined sheet metal panels to force those panel sections into tight overlapping contact.

Another principal feature of the invention provides an apparatus for applying the required compressive force against the folded portion of the standing seam in order to close and seal the seam. The apparatus includes an anvil member having a first compressive surface adapted to register with one side of the standing seam, and a compression plate member having a second compressive surface adapted to register with the other side of the standing seam. Means are provided for moving the compressive surfaces toward one another against the side surfaces of the standing seam to exert a compressive pressure against those seam surfaces. The apparatus is prepared to take the form of a body member mounted on wheels to be rolled along the elongated standing seam joint structure atop the roof surface to successively compress 12 inch sections of the seam.

In accordance with another feature of the invention set forth in an alternative embodiment, a gasketing material is not applied to the seam and the standing seam is conventionally formed and press fitted as described above. A continuous weld is then formed by a seam welder and the like in the web section of the panel edge portion just beneath the seam to insure a water-tight joint when bare stainless or even plain carbon sheet metal panels are used. In accordance with this alternative feature of the invention, it is possible to effect repairs to existing roofs using standing seam construction. It is also preferred to use this alternative arrangement when constructing roofing systems without cleats since a cleatless roof system removes two metal thicknesses from the seam which rigidity loss is more than compensated for by the continuous weld. In all instances, pressing the seam together in a press fit manner establishes a tight seam and continuous welding the joint below the seam removes pressure from the seam itself so that seam tightness remains. Thus, the seam, even though not gasketed, is better able to resist penetration of water or moisture and any damage done by water expansion upon freezing in contrast to prior art systems.

It is an object of the present invention to provide a standing seam joint structure for sheet metal roofing panels which is strong, watertight, and easy to construct.

Another object of the invention is to provide a standing seam joint structure for sheet metal roofing panels which provides a watertight seal without the need for soldering or welding.

Yet another object of the present invention is to provide a standing seam joint structure of sheet metal roofing panels which enables the use of a standing seam on roof structures which have little or no slope and which consequently experience the buildup of ice and snow.

A further object of the invention is to provide an apparatus for closing and sealing a standing seam against the influx of water without the need for soldering or welding.

It is yet another object of the invention to provide a sheet metal roofing system suitable for use with roofs having little, if any, pitch which uses a standing seam to joint adjacent sheet metal panels.

Still yet another object of the invention is to provide a roofing system which is easier to install than prior art systems.

These and other objects of the invention will become apparent from the following description of a preferred embodiment thereof taken together with the accompanying drawings.

BRIEF DESCRIPTION OF THE DRAWINGS

FIG. 5 is a cross-sectional view of a standing seam joint structure in accordance with the present invention including a schematic representation of another step taken in accordance with the present invention;

FIG. 6 is a top plan view of a roofing system with elements partially broken away to show the positioning of the cleat used in the system;

FIG. 7 is an end elevation view of a machine designed to compress the standing seam and shown in its unactuated position;

FIG. 8 is a view similar to FIG. 7 but showing the machine in an actuated position;

FIG. 9 is a side elevation view of the compression plate member of the machine shown in FIGS. 7 and 8 taken along line 9—9 of FIG. 8;

FIGS. 10 and 11 are partial end elevation, schematic views of alternative embodiments of the compression plate and anvil of the machine shown in FIGS. 7–9;

FIGS. 12*a* through 12*e* are schematic illustrations of the steps used in forming a standing seam including the press fit step of the present invention from conventionally formed panels such as may be formed at the job site;

FIG. 16 is a schematic, cross-sectional view of a further alternative embodiment of the invention showing a sheet metal joint having a standing seam.

DESCRIPTION OF THE PREFERRED EMBODIMENTS

Figure 1:
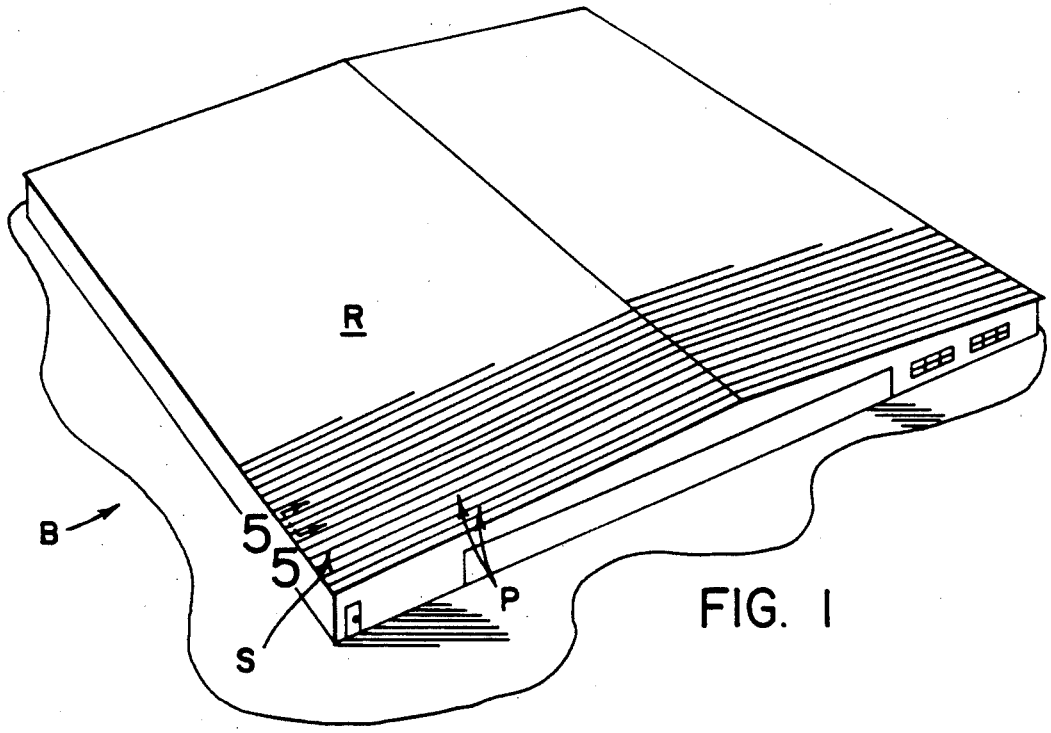
FIG. 1 is a pictorial view of a building having a roof assembly in a standing seam joint structure in accordance with the present invention.
Figure 2:
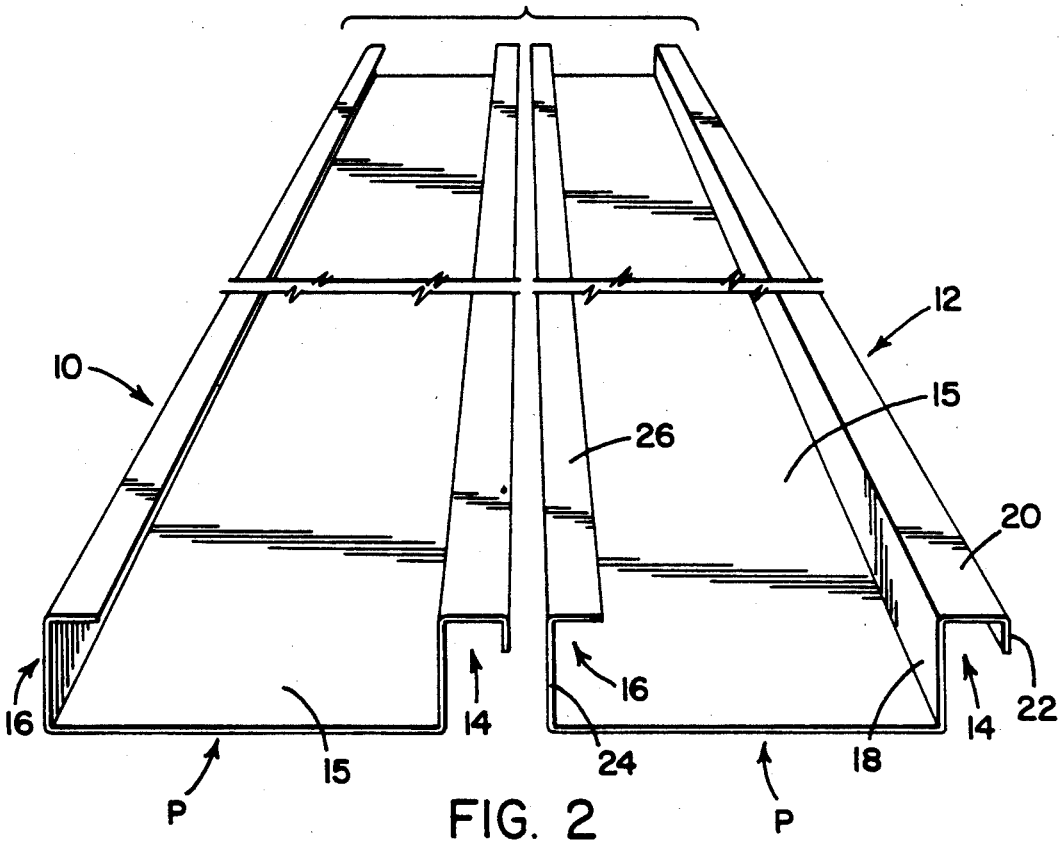
FIG. 2 is a perspective view of a pair of adjacent roofing panels used in forming a standing seam joint structure in accordance with the invention.

Referring now to the drawings wherein the showings are for the purpose of illustrating a preferred embodiment of the invention and not for the purpose of limiting the invention, in FIGS. 1 and 2 there is shown a building B having a roof assembly R comprising adjacent elongated panels P joined together by means of elongated standing seams S.

As best shown in FIG. 2, roofing panels P are preferably preformed in the shape of elongated pans. Preformed pans are commercially available from suppliers such as Follansbee Steel Company, a division of the assignee of the present invention. Preformed pans are typically furnished in lengths of up to about 20 feet. Alternatively, as for larger lengths, panels P may be formed at the construction site from a roll of sheet stock by a pan forming machine. Panels P formed at the site take a somewhat different shape than the preformed pans shown in FIG. 2, i.e. see FIG. 12. For purposes of this specification, the term panels P means either preformed pans or pans formed by a pan forming machine.

Figure 13:
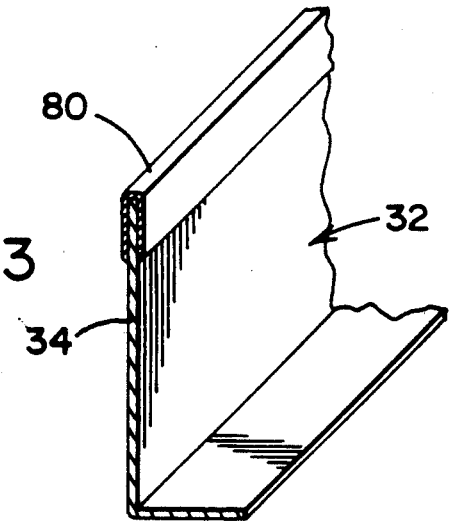
FIG. 13 is a perspective, schematic view of an alternative embodiment showing application of a separate solder gasket to the top section of one of the joint members.
Figure 14:
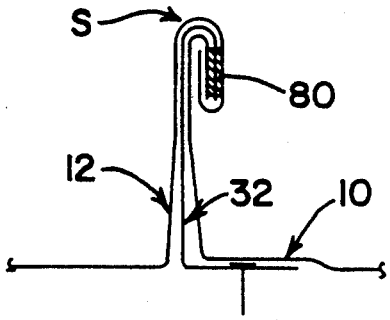
FIG. 14 is a schematic, cross-sectional view of the seam form using the alternative embodiment shown in FIG. 13.
Figure 15:
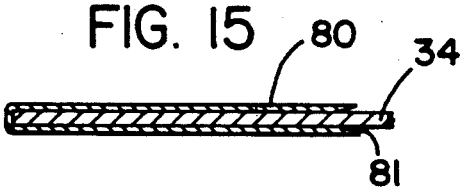
FIG. 15 is a cross-sectional view of the solder gasket shown in FIG. 13.

Panels P can be formed from any suitable sheet metal of standard gauge thicknesses typically used in the metal roofing industry. That is, the sheet metal could be plain carbon or bare stainless steel. However, in the preferred embodiment of the invention, a Terne coated stainless steel of sheet metal gauge is specified. When bare stainless (or plain carbon if specified) is to be used in the roofing system, the alternative embodiment shown in FIGS. 13–15 is to be employed, or further, the alternative embodiment of FIG. 16 can be used. Terne Coated stainless steel is a classified coating process which is commercially available. For roofing applications, it is a coating composition of about 20% tin and 80% lead (i.e. solder) of a relatively heavy thickness, i.e. about 40 pounds for gauges IC (30 ga), 1X (28 ga) and 2x (26 ga) although 20 pound coatings could be used. Terne Coated stainless steel can be conventionally painted, has long life, etc. For purposes of this invention, it was discovered that the coating becomes plasticized or deformed under pressure and, when deformed, the coating can function as a gasket for sealing a joint.

A typical pair of adjacent roofing panels P is shown in FIG. 2 to comprise a pair of similar preformed pans 10 and 12 having duplicate features designated herein with duplicate enumeration. Both the first pan 10 and the second pan 12 have a right edge portion 14 and a left edge portion 16. The right edge portion 14 comprises a first vertical web section 18, an outturned first horizontal flange section 20, and a first, downwardly turned edge section 22. The left edge portion 16 comprises a second vertical web section 24 and an inturned second horizontal flange section 26 which are somewhat identical to first section 18, 20 respectively. It is to be understood that the terms "vertical" and "horizontal" are used herein to describe the relative positions of the panel sections as shown in cross section in the Figures and not necessarily to designate absolute positions with respect to the building B or the earth. Edge portions 14, 16 are at the ends of a flat horizontal roof covering base portion 15 of panel P. For ease of assembly the preformed panels P have a base portion 15 width at one axial end thereof which is slightly less than that at the other axial end, i.e. 1/16".

Figure 3:
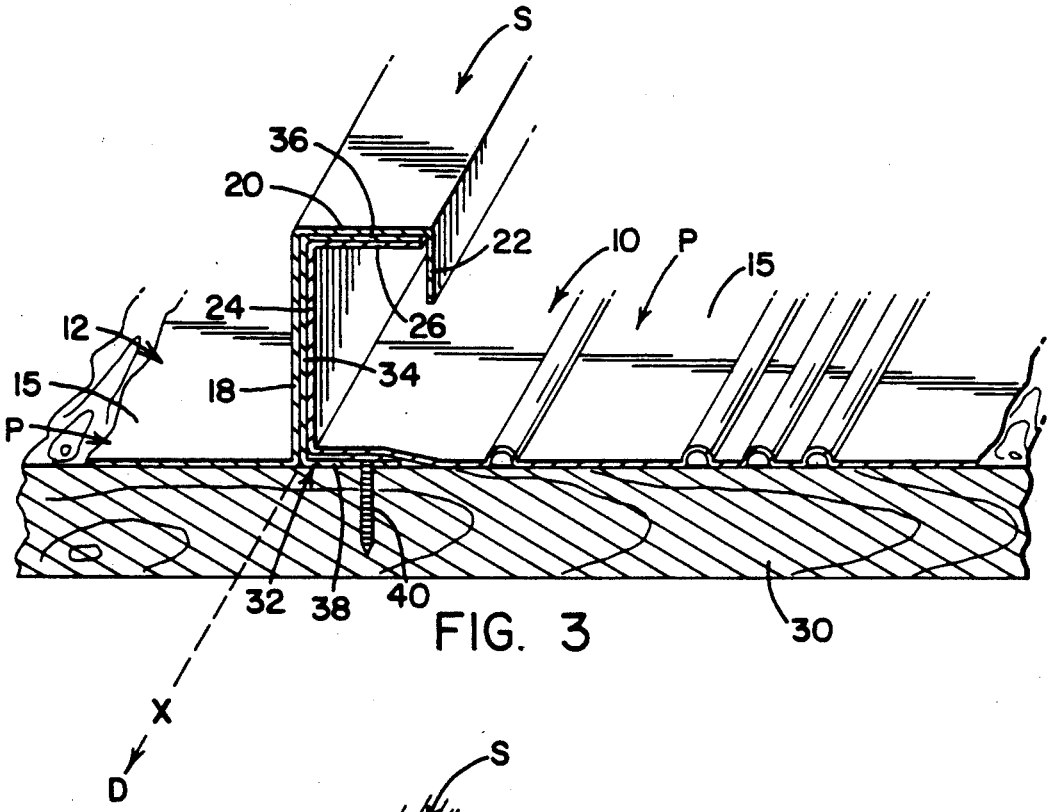
FIG. 3 is a cross-sectional view showing the initial assembly on a roof substrate of two adjacent roofing panels with an anchor cleat.

In FIG. 3 pans 10 and 12 are shown in positions taken as typical adjacent panels P on the roof substrate 30. The panels 10 and 12 in this position are in substantially adjacent relationship to define an elongated direction D of the standing seam S. A base line X may first be established to define the elongated direction D. Also shown in FIG. 3 and in FIG. 6 is a cleat 32 having a vertical web section 34, a horizontal cleat edge section 36, and a base section 38 rigidly anchored to the substrate 30 by means of nails 40 or other suitable rigid fasteners. The cleat 32 is preferred to be elongated in the longitudinal direction of the standing seam S as shown in FIG. 1, and ideally would extend substantially the entire length of the standing seam S. The left edge portion 16 of the first pas 10 registers with the cleat 32 in a position with the second vertical web section 24 adjacent to the vertical cleat web section 34, and with the second horizontal flange section 26 received beneath the horizontal cleat edge section 36. The right edge portion 14 of the second pan 12 registers with the cleat 32 in a position with the first vertical web section 18 adjacent to the vertical cleat web section 34; the first horizontal flange section 20 overlapping the horizontal cleat edge section 36 and the second horizontal flange section 26 of the first pan 10; and the downwardly turned edge section 22 extending vertically downward beyond those overlapping sections. When registered with one another as shown in FIG. 3, the first and second pans 10 and 12 and the cleat 32 are arranged in a position of readiness for the steps to be taken in folding and sealing of the standing seam S in accordance with the invention.

Figure 4:
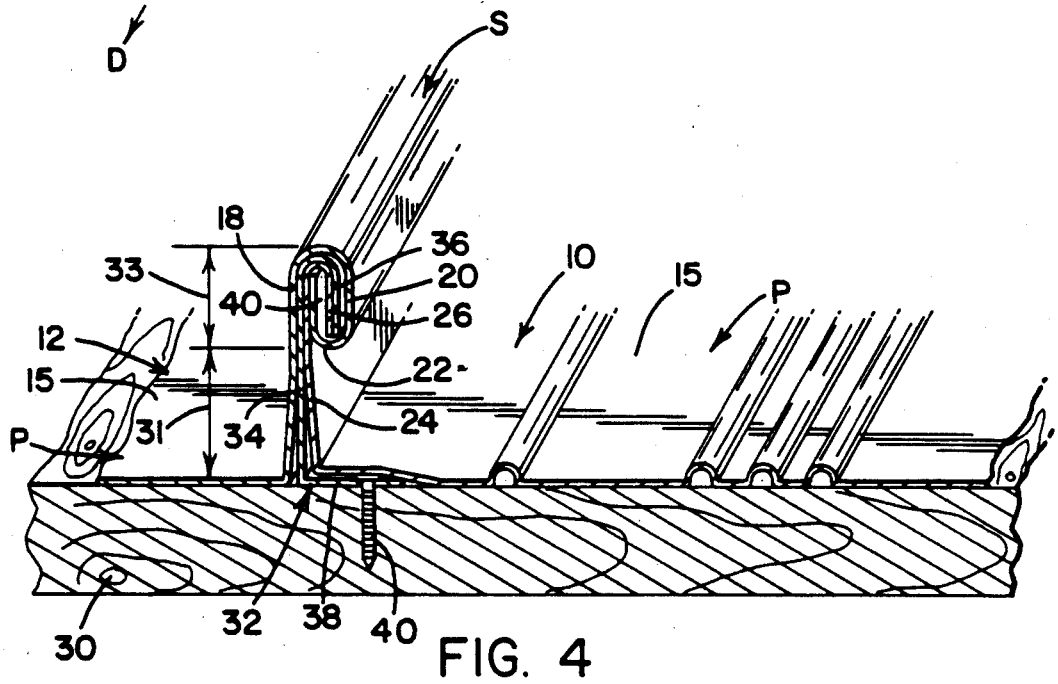
FIG. 4 is a cross-sectional view of a standing seam joint structure including a schematic representation of a step taken in accordance with the method of the present invention.
Figure 17:
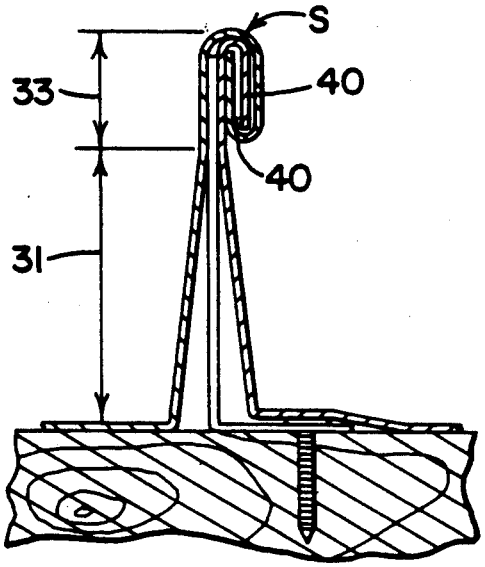
FIG. 17 (PRIOR ART)
FIGS. 17 and 18 are cross-sectional views of prior art standing seams and joints.
Figure 18:
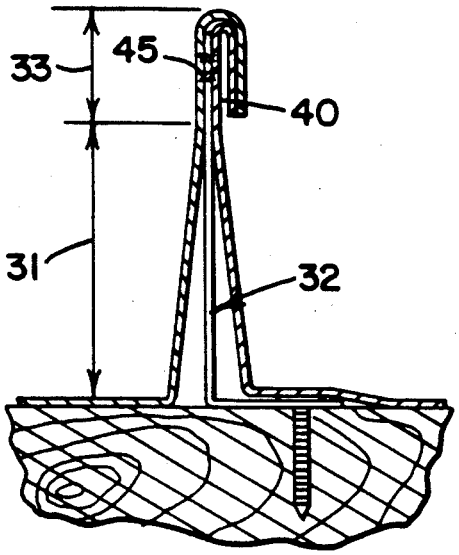
FIG. 18 (PRIOR ART)

A standing seam is produced by conventional seaming machinery known in the art which is used to crimp and fold the arrangement of components shown in FIG. 3 into the arrangement of those same components as shown in FIG. 4 to produce a standing seam S. More specifically, standing seam S shown in FIG. 4 is produced from preformed pan edge portions 14, 16 of pans 10, 12 and cleat 32 to form a seam S which, for definitional purposes, has an undisturbed web section 31 and a bent edge section 33. Web section 31 continues for a predetermined distance so that edge section 33 of seam S is positioned sufficiently above panel base portion 15 to avoid standing water on the roof while at the same time permitting thermal expansion and contraction of pan base portions 15. Referring now to FIGS. 12*a*–12*d*, the standing seam S is shown developed in FIGS. 12*b* to 12*d* from panels P constructed at the site by a pan forming machine. In this instance, the right edge portion 14 of one panel P abuts left edge portion 16 of an adjacent panel P with cleat 32 interposed therebetween to produce an arrangement schematically shown in FIG. 12*a* which corresponds to FIG. 3. The conventional seaming machine then crimps and folds over the edge sections to produce a standing seam joint S which like that shown in FIG. 4 has an undisturbed web section 31 and a bent edge section 33. In both standing seam arrangements, the edge section 33 of standing seam S comprises 7 thicknesses or plies of the sheet metal. As thus far described, the arrangement may be viewed as conventional. Significantly, while several metal thicknesses may be in line-to-line contact, there are several spaces, shown as numeral 40 in FIGS. 4 and 12*d*. Spaces 40 are better illustrated in FIG. 17 which shows a conventional seam and FIG. 18 which discloses the System Fagersta arrangement discussed above. FIG. 17 may be viewed as equivalent to FIG. 4. Spaces 40 prevent the seam S from being watertight and prevent its application to flat roofs or roofs with little pitch in spite of web section 31. The FIG. 18 prior arrangement uses welds 45 and intermittently spaced cleats 32 to provide a waterproof seam and hence application of a standing seam S to flat roof systems. In the FIG. 18 system, right and left side pan edge portions 14, 16 are first welded at 45 and the flange then simply folded over to define a 6 ply (when cleat 32 is used) or 4 ply bent edge section 33. In flat roof applications, water, from ice and snow, can accumulate in spaces 40 (especially so because of the lesser number of plies or thicknesses in the seam) and upon expansion from thawing and freezing, eventually crack welds 45. Once cracked, the joint becomes very difficult to repair since the folded over edges must be straightened to permit welding, etc.

The invention is schematically shown in FIG. 5 to include a strong compressive pressure force 47 which is applied to the bent edge section 33 standing seam S of FIG. 4 to provide a strong, water-tight seal. The compressive force is such that a seam in the nature of a press fit assembly is produced. The water-tight seal is produced because (a) the spaces 40 in the prior art do not exist and (b) the compressive force 47 is high enough to plasticize or deform the gasket material in the seam. As discussed above, the gasket material is the Terne Coating applied to pans 10, 12 which act as a sealant for sealing seam S when deformed. The Terne Coating, which is a lead-tin composition is viewed as a solder. Preferably, pans 10, 12 and cleat 32 are Terne Coated stainless steel. However, the Terne Coating only need be applied to the sections of pan edge portions 14, 16 which make up the bent edge section 33 of standing seam S. Furthermore, cleat 32 which is continuous, can be especially coated so that pans 10, 12 can be supplied as bare stainless steel (or even plain carbon steel). For example, web section 34 can have a metal thickness of about 0.010" and then be Terne Coated with a thickness of about 0.005" to produce a gauge of about 0.015" and this can provide sufficient gasket material to seal standing seam S. Also, a stronger standing seam is produced. In this connection, it is noted that the standing seam under discussion has 7 plies or thicknesses and the 7th section is downwardly turned, edge section 22 of right side edge portion 14 which is folded around and under as shown in the drawings so that when the standing seam is compressed as shown in FIG. 5, the 7th section is substantially crimped and deformed to materially enhance the seal and strength of standing seam S. At the same time, standing seam S retains its web 31 to permit thermal contraction of the roof assembly, to provide a seam at a spaced distance away from water, etc. Importantly, the system as described is applicable to roof installations which are almost flat. That is, a pitch as low as ½" to a foot has been successfully employed as contrasted to FIG. 17 prior art standing seam S which can be applied to roofs with pitches no less than about 3 or 4" to the foot.

A compressing apparatus 50 is provided to carry out the closing and sealing process in accordance with the invention and is shown in FIGS. 7, 8 and 9. The compressing apparatus 50 comprises a body member 52 with a handle 54 at the top side and a set of wheels 56 at the bottom side. A sufficient number of wheels 56 is provided to enable the compressing apparatus 50 to stand upright on the roof assembly R as shown in FIG. 7. Also provided at the bottom side of the body member 52 is a pair of hydraulic cylinders 58 rigidly mounted to the body member 52 and having an associated pair of piston rods 60; a compression plate 62 carried on the ends of the piston rods 60; an anvil 64 rigidly mounted to the body member 52; and spring means 66 acting between the anvil 64 and the compression plate 62 to bias the compression plate 62 away from the anvil 64. Means for controlling operation of the compressing apparatus 50 is provided and are shown schematically in FIG. 7 as controller 70.

In use, the compressing apparatus 50 is placed in position with respect to the standing seam S as shown in FIG. 7 with the anvil 64 abutting against bent edge section 33 at the first vertical section 18. The controller 70 is then activated to cause the hydraulic cylinders 58 to move the piston rods 60 and the compression plate 62 in a single action stroke towards the anvil 64 against the bias of the spring means 66 to compress bent edge section 33 of standing seam S tightly (in a press fit manner) between the compression plate 62 and the anvil 64 as shown in FIG. 8. The spring means 66 thereafter acts to push the compression plate 62 and the piston rods 60 in a return stroke opposite to the single acting stroke driven by the hydraulic cylinders 58. The compressing apparatus 50 is then manually rolled along the surface of the roof assembly R to a position wherein a successive section of the standing seam S is to be compressed together.

Pressure applied to bent edge section 33 of the standing seam S is determined by the level of force exerted by the hydraulic cylinders 58 and by the area of the seam surface acted upon by the compression plate 62 and this in turn is correlated to the sheet metal gauge of the pan steel. For example, bent edge section 33 of standing seam S is preferred to have a vertical dimension of approximately ½ inch as shown in FIG. 9, and the compression plate 62 is preferred to have a length of 12 inches. An area A of 6 square inches at the folded upper portion 42 is thereby acted upon between the compression plate 62 and the anvil 64. In the practice of the invention, it is found for standard gauges of roofing sheet metal that satisfactory results are obtained over a force rang extending from approximately 3,000 pounds of force to approximately 10,000 pounds of force at each of the piston rods 60, with the resultant application of approximately 1,000 pounds per square inch to approximately 3,333 pounds per square inch of pressure applied to the surface area A. The preferred level of pressure applied to the surface area A by the compressing apparatus 50 is 2,000 pounds per square inch, which results from application of 6,000 pounds of force at each of the piston rods 60.

The compression plate 62 and the anvil 64 are preferred respectively to have flat compression surfaces 72 and 74 to define a unitary planar surface A therebetween on the standing seam S. However, the scope of the invention is intended to include compression surfaces on the compression plate 62 and/or the anvil 64 which could provide a pinching compressive effect on a relatively narrow surface area as would the surfaces 75 and 76 shown in FIGS. 10 or a corrugated compressive effect on separate surface areas as would be produced by the raised surfaces 77 and 78 shown in FIG. 11. The alternative arrangements shown in FIGS. 10 and 11 would crimp standing seam S and form indentations therein and an additional spring arrangement (not shown) would be applied to anvil 64 to cause apparatus 50 to open after application.

An alternative embodiment of the invention is shown in FIGS. 13, 14 and 15 for use when pans 10, 12 and cleat 32 are supplied as bare stainless steel. In such instances, a gasket arrangement must be provided. Preferably, the gasket comprises a solder in the form of a U-shaped cap 80 which is applied to the end of web section 34 of cleat 32. Cap 80 could be slightly flared as shown in FIG. 15 at its open end 81 to permit easy application in sections to cleat 32 prior to abutting pans 10, 12 against cleat 32. Cap 80, being formed from a lead-tin solder composition deforms under pressure from the compressive step of the invention shown in FIGS. **12*e* and 5 to produce a water-tight standing seam S as described above. Optionally, solder cap 80 could be applied in addition to one or both of the ends of the edge sections of the edge portions of pans 10, 12 or in lieu of the cap applied to cleat 32. For example, in FIG. 14, a solder cap 80 may be additionally installed onto horizontal flange section 20. Again, solder cap 80 deforms under pressure to provide a gasketing or sealing of standing seam S. It will be appreciated that solder cap 80 will only produce a very fine, thin stream of solder between certain sections of standing seam S, and it is not inconceivable that in certain southern sections of the country, enough heat could be developed to melt some of the solder within standing seam S thus strengthening the joint. However, this is not necessary for the working of the invention. It is mentioned only with respect to a potential enhancement of the joint described above when a Terne Coating or solder cap is used with the invention. The press fit seam, with the soldered gasket as described above, has more than sufficient strength for a flat roof application. Thus, it is possible to replace solder cap 80** with a cap made of a suitable caulking material such as the butyl rubber or vinyl caulks used in the construction industry for flashing applications and the like.

A still further alternative embodiment of the invention is shown in FIG. 16. This embodiment shows conventional resistance welding apparatus 90 used to weld pan edge portions 14, 16 together in web sections 31 as shown by numeral 91. The welding apparatus 90 will develop sufficient compressive force to deflect web sections 31 from the normal vertical angle these sections usually make with pan base 15, but there will still be a sufficient angle-distance of web section 31 to permit thermal contraction and expansion of pan base 15. Of course, the bent edge section 33 of standing seam S of the FIG. 16 embodiment has been compressed by apparatus 50 so that water could not get into standing seam S in the first place, but if water did, it could not adversely affect weld 91. Preferably, weld 91 is continuous but the weld could be a spot weld or even in theory a sealed riveted connection. The FIG. 16 embodiment is preferably used in the following applications:

(a) when pans 10, 12 and cleat 32 are supplied in bare stainless steel and no gasket arrangement (Terne Coating or the solder cap shown in the FIGS. 13–15 alternative embodiment) is used, or (b) when a repair to an existing roof using a standing seam S construction is required. In this instance, apparatus 50 would press fit standing seam S and resistance welder 90 would insure sealing of the joint, or (c) when cleat 32 is not used in the roofing system. As noted above, when cleat 32 is deleted, the wall thickness or plies of standing seam S is reduced to about 5 thicknesses and the joint formed by press fitting standing seam S by apparatus 50 is weaker. Thus, it is desired to weld web section 31. In cleatless applications, ballast or gravel is added to base section 15 of pans 10, 12 to keep the roof in place.

The invention has been described with reference to a preferred and alternative embodiments. It will be appreciated that modifications or alterations which would not deviate from the present invention will occur to others upon their reading and understanding of this specification. It is intended that all such modifications be included insofar as they come within the scope of the invention.

It is thus the essence of my invention to provide a roofing system which uses an improved standing seam that is rendered water-tight by a press fit compression operation which includes a plastically deformed gasket arrangement so that a standing seam can be applied to roofs with little, if any, pitch.

Having thus described the invention, it is claimed:

1. In a sheet metal roof assembly including a plurality of roof panels inclined in a generally horizontal plane having vertically extending edge flange portions, said edge flange portions having edge sections at the upper ends thereof, said panels positioned adjacent one another so that an edge flange portion of one panel is disposed adjacent and parallel to the edge flange portion of another panel and the edge section of one of said adjacent panels is folded over and around the edge section of the other adjacent panel to define a standing seam joint, the improvement comprising:

a continuous sheet metal cleat interposed between said edge flange portions of said adjacent panels and having an upper edge section folded together with the said folded over edge sections of said edge flange portions to define a seven ply standing seam which extends the length of said standing seam and is comprised solely of plies of said panel edge flange portions and said cleat, said folded edge sections of said edge flange portions and said cleat being compressed flatwise together in a tight flattened press fit contact with each other under a pressure of at least about 1,000 pounds per square inch of their surface contact area such that substantially no space exists between said edge sections in said standing seam, and gasket means of compressible and plastically deformable solidified material within and compressively deformed between said folded edge sections of said edge flange portions and cleat for sealing said joint without the application of heat whereby a soldered, completely sealed and weld-free flattened standing seam joint results to permit an improved roofing assembly to be installed for roofs with little pitch.

2. The improvement of claim 1 wherein said gasket means includes a compressively deformable coating on said panels, said coating applied at least to one of said edge sections and compressed and plastically deformed in said joint to seal the same.

3. The improvement of claim 2 wherein said panels are formed from Terne Coated steel, said gasket means including the coating on said steel.

4. The improvement of claim 1 wherein the edge section of one of said vertically-extending edge flange portions is folded outwardly over both the folded over adjacent edge sections of the other one of said vertically-extending edge flange portions and said cleat and is double folded inwardly back over said folded over adjacent edge sections of said edge flange portion and cleat.

5. The improvement of claim 4 wherein the said double folded back portion of the edge section of the said one of said vertically-extending edge flange portions extends between and is in flat press fit contact throughout its entirety with the folded together edge sections of said other one of said edge flange portions.

6. The improvement of claim 4 wherein the said gasket means includes a compressively deformable solidified coating on said panels, said coating applied at least to one of said edge sections and compressed and plastically deformed in said joint to seal the same.

7. The improvement of claim 6 wherein the said panels are formed from Terne coated steel, said gasket means including the coating on said steel.

8. The improvement of claim 5 wherein the said gasket means includes a compressively deformable solidified coating on said panels, said coating applied at least to one of said edge sections and compressed and plastically deformed in said joint to seal the same.

9. The improvement of claim 8 wherein the said panels are formed from Terne coated steel, said gasket means including the coating on said steel.

* * * * *